US010422131B2

(12) United States Patent
Imbeau et al.

(10) Patent No.: US 10,422,131 B2
(45) Date of Patent: Sep. 24, 2019

(54) RIGID INSULATING PANEL AND RIGID INSULATION PANEL ASSEMBLY

(71) Applicant: GROUPE ISOLOFOAM INC., Ste-Marie de Beauce (CA)

(72) Inventors: Daniel Imbeau, Quebec (CA); Michel Labonté, Sainte-Marie (CA)

(73) Assignee: GROUPE ISOLOFOAM INC., Ste-Marie de Beauce, Quebec (CA)

( * ) Notice: Subject to any disclaimer, the term of this patent is extended or adjusted under 35 U.S.C. 154(b) by 127 days.

(21) Appl. No.: 14/473,583

(22) Filed: Aug. 29, 2014

(65) Prior Publication Data

US 2015/0121799 A1 May 7, 2015

Related U.S. Application Data

(60) Provisional application No. 61/898,669, filed on Nov. 1, 2013.

(51) Int. Cl.
*E04C 2/20* (2006.01)
*E04B 2/84* (2006.01)
(Continued)

(52) U.S. Cl.
CPC ..... *E04C 2/205* (2013.01); *E04B 1/80* (2013.01); *E04B 2/847* (2013.01); *E04B 1/6179* (2013.01); *E04B 2/86* (2013.01); *E04C 2002/004* (2013.01)

(58) Field of Classification Search
CPC ..... E04C 2/205; E04C 2002/004; E04B 1/80; E04B 2/847; E04B 1/6179; E04B 2/86;
(Continued)

(56) References Cited

U.S. PATENT DOCUMENTS 1,823,039 A * 9/1931 Gruner ..... E04F 15/04 52/592.4
4,052,831 A 10/1977 Roberts et al.
(Continued)

FOREIGN PATENT DOCUMENTS

CA 2866109 * 9/2012 ..... E04F 15/00
DE 10206835 9/2003
(Continued)

*Primary Examiner* — Brian D Mattei
(74) *Attorney, Agent, or Firm* — Merchant & Gould P.C.

(57) ABSTRACT

A rigid insulating panel comprising an insulating material core with an R-value of at least 2.5 (hr·ft$^2$·° F.)/BTU·in. The insulating material core has opposed first and second surfaces, a pair of spaced-apart longitudinal edges, and a pair of spaced-apart lateral edges extending between the pair of longitudinal edges. At least one of the pair of longitudinal edges and the pair of lateral edges comprises connecting members including a tongue and groove assembly with an inner groove and an outer tongue separated by a substantially S-shaped median wall. The tongue and groove assembly is engageable with the tongue and groove assembly of an adjacent insulating panel to provide a flexible interconnection therebetween. The rigid insulating panel also comprises at least one membrane covering one of the first surface and the second surface. An assembly method for insulating a concrete surface of a building using an assembly of insulating panels is also provided.

24 Claims, 8 Drawing Sheets

(51) Int. Cl.

| | |
|---|---|
| ***E04B 1/80*** | (2006.01) |
| ***E04C 2/00*** | (2006.01) |
| ***E04B 1/61*** | (2006.01) |
| ***E04B 2/86*** | (2006.01) |

(58) Field of Classification Search

CPC ..... E04F 15/02038; E04F 15/02033; E04F 2201/023; E04F 2201/0138; E04F 2201/04; E04F 2201/0146; E04F 2201/0153

USPC ..... 52/309.4, 309.8, 506.01, 509, 588.1, 52/589.1, 539

See application file for complete search history.

(56) References Cited

U.S. PATENT DOCUMENTS

| | | | | |
|---|---|---|---|---|
| 4,122,203 | A | 10/1978 | Stahl | |
| 4,437,287 | A * | 3/1984 | Halfaker | 52/588.1 |
| 4,530,877 | A | 7/1985 | Hadley | |
| 5,133,654 | A | 7/1992 | Sheen | |
| 5,220,760 | A | 6/1993 | Dimakis | |
| 5,345,738 | A | 9/1994 | Dimakis | |
| 5,636,489 | A * | 6/1997 | Leverrier et al. | 52/540 |
| 6,018,918 | A | 2/2000 | Long, Sr. | |
| 6,263,574 | B1 * | 7/2001 | Lubker et al. | 29/897.32 |
| 6,276,104 | B1 * | 8/2001 | Long et al. | 52/309.4 |
| 6,523,324 | B1 | 2/2003 | Porter | |
| 6,599,621 | B2 | 7/2003 | Porter | |
| 6,766,622 | B1 | 7/2004 | Thiers | |
| 7,168,217 | B2 | 1/2007 | Weber | |
| 7,617,651 | B2 | 11/2009 | Grafenauer | |
| 7,874,118 | B2 | 1/2011 | Schitter | |
| 7,914,914 | B2 | 3/2011 | Tinianov | |
| 7,918,062 | B2 | 4/2011 | Chen | |
| 8,082,717 | B2 | 12/2011 | Dammers | |
| 2005/0159057 | A1 | 7/2005 | Hauber et al. | |
| 2006/0019568 | A1 | 1/2006 | Toas et al. | |
| 2006/0123723 | A1 | 6/2006 | Weir et al. | |
| 2008/0016802 | A1 | 1/2008 | Rheaume | |
| 2008/0168728 | A1 | 7/2008 | Scherrer | |
| 2008/0241440 | A1 * | 10/2008 | Bauer | 428/33 |
| 2008/0245007 | A1 | 10/2008 | McDonald | |
| 2008/0295450 | A1 | 12/2008 | Yogev | |
| 2009/0313935 | A1 | 12/2009 | Montgomery | |
| 2010/0101457 | A1 | 4/2010 | Surace et al. | |
| 2011/0047908 | A1 * | 3/2011 | Brusman et al. | 52/220.1 |
| 2011/0047912 | A1 | 3/2011 | Armijo | |
| 2011/0064901 | A1 | 3/2011 | Blackburn et al. | |
| 2011/0197530 | A1 | 8/2011 | Bahnmiller | |
| 2011/0214372 | A1 * | 9/2011 | Mullet et al. | 52/309.4 |
| 2011/0258959 | A1 * | 10/2011 | Braun | 52/588.1 |
| 2011/0266088 | A1 | 11/2011 | Koike et al. | |
| 2012/0073217 | A1 * | 3/2012 | Wilson et al. | 52/105 |
| 2012/0073228 | A1 | 3/2012 | Fork et al. | |
| 2012/0180416 | A1 * | 7/2012 | Perra et al. | 52/309.1 |
| 2013/0247502 | A1 * | 9/2013 | Zhang | 52/588.1 |
| 2015/0047282 | A1 * | 2/2015 | Ford | E04F 15/0215 52/309.1 |

FOREIGN PATENT DOCUMENTS

| | | | |
|---|---|---|---|
| DE | 102010018452 | | 10/2011 |
| DE | 202011106980 | | 11/2011 |
| DE | 202011106980 | U1 | 11/2011 |
| EP | 46256 | A1 | 2/1982 |
| EP | 0085196 | | 8/1983 |
| FR | 2585747 | A1 | 2/1987 |
| GB | 1516552 | | 7/1978 |
| GB | 2238329 | A | 5/1991 |
| SU | 885489 | A1 | 11/1981 |
| WO | 2012001399 | A1 | 1/2012 |

* cited by examiner

RIGID INSULATING PANEL AND RIGID INSULATION PANEL ASSEMBLY

CROSS-REFERENCE TO RELATED APPLICATIONS

This application claims priority under 35USC§ 119(e) of U.S. provisional patent application 61/898,669 filed on Nov. 1, 2013, the specification of which is hereby incorporated by reference.

FIELD OF THE INVENTION

The present invention relates to the field of insulating panels. More particularly, it relates to a rigid insulating panel configured to provide high structural integrity and a flexible interlock joint between adjacent panels joined to one another. It also relates to a rigid insulating panel assembly including a plurality of adjacent interconnected insulating panels.

BACKGROUND

Rigid insulating panels are known in the art for insulating a building structure by creating an insulated barrier to provide a maximum efficiency of heating, ventilating, and air conditioning (HVAC) systems. In order to cover a surface of a building structure, a plurality of insulating panels are usually provided in an edge to edge adjacent configuration, to form an insulating panel assembly, where the panels are juxtaposed at the edges and form a large flat surface. For example and without being limitative, the edge of the rigid insulating panels can be flat, with a shiplap or with a non-interlocking groove to allow the juxtaposition thereof.

Rigid insulating panels commonly found on the market, and manufactured to be used in such insulating panel assembly, however, normally tend to be improperly adapted for use on specific surfaces. For example, when the panels are used on uneven surfaces, the connectors for connecting adjacent panels and/or the core of the panels often break, or spread open, thereby resulting in a breach in the isolation, which is undesirable. For example, such a problem occurs frequently when the insulating panels are used over gravel, crushed stone, or the like, under a concrete floor.

In view of the above, there is a need for improved rigid insulating panels, and insulating panel assemblies which, would be able to overcome or at least minimize some of the above-discussed prior art concerns.

SUMMARY OF THE INVENTION

According to a first general aspect, there is provided a rigid insulating panel. The rigid insulating panel comprises an insulating material core with an R-value of at least 2.5 (hr·ft$^2$·° F.)/BTU·in. The insulating material core has opposed first and second surfaces, a pair of spaced-apart longitudinal edges, and a pair of spaced-apart lateral edges extending between the pair of longitudinal edges. At least one of the pair of longitudinal edges and the pair of lateral edges comprises connecting members including a tongue and groove assembly including an inner groove and an outer tongue separated by a substantially S-shaped median wall. The tongue and groove assembly is engageable with the tongue and groove assembly of an adjacent insulating panel to provide a flexible interconnection therebetween. The rigid insulating panel also comprises at least one polymeric-based membrane covering one of the first surface and the second surface of the insulating material core.

In an embodiment, the S-shaped median wall comprises an inflection point positioned at a median of the insulating material core of the rigid insulating panel, between the first and the second surfaces.

In an embodiment, the S-shaped median wall defines consecutive convex and concave sections in the inner groove and the outer tongue with the inflection point being located at the junction of the convex and concave sections.

In an embodiment, the tongue and groove assembly has a length and the insulating material core has a thickness between the first and the second surfaces and the length of the tongue and groove assembly is at maximum ⅓ of the thickness of the insulating material core.

In an embodiment, the outer tongue and the inner groove extend substantially perpendicular to the first surface and the second surface of the insulating material core.

In an embodiment, the at least one polymeric-based membrane comprises a first polymeric-based membrane covering the first surface of the insulating material core and a second polymeric-based membrane covering the second surface of the insulating material core.

In an embodiment, at least one of the at least one polymeric-based membrane is a micro-perforated polymeric-based membrane.

In an embodiment, the at least one polymeric-based membrane is free of continuous discontinuity between a first one of the edges and a second one of the edges, opposed to the first one of the edges.

In an embodiment, the insulating material core is formed of one of shaped expanded polystyrene, extruded polystyrene, polyurethane, polyisocyanurate and phenolic foam.

In an embodiment, a thickness of the rigid insulating panel is between about 0.75 inch and about 6 inches.

In an embodiment, the insulating material core has a compressive strength of between about 8 psi and about 40 psi.

According to another general aspect, there is also provided a rigid insulating panel assembly. The rigid insulating panel assembly comprises at least two rigid insulating panels and each one of the rigid insulating panels comprises an insulating material core having a first surface, an opposed second surface, a pair of spaced-apart longitudinal edges and a pair of spaced-apart lateral edges extending between the pair of longitudinal edges, and at least two connecting members at a respective one of the longitudinal edges and the lateral edges. Each one of the connecting members comprises a median wall separating an inner groove and an outer tongue together defining a tongue and groove assembly. The median wall has an inflection point positioned at a median of the insulating material core. The rigid insulating panel assembly also comprises at least one polymeric-based membrane covering one of the first surface and the second surface of the insulating material core. Adjacent ones of the connecting members of the at least two rigid insulating panels are engageable together with the inflection points allowing flexible interlock between the adjacent ones of the at least two rigid insulating panels.

In an embodiment, the median wall is S-shaped and defines consecutive convex and concave sections in the inner groove and the outer tongue with the inflection point being located at the junction of the convex and concave sections.

In an embodiment, the tongue and groove assembly has a length and the insulating material core has a thickness between the first surface and the second surface and the length of the tongue and groove assembly is at maximum ⅓ of the thickness of the insulating material core.

In an embodiment, the outer tongue and the inner groove extend substantially perpendicular to the first surface and the second surface of the insulating material core.

In an embodiment, the at least one polymeric-based membrane comprises a first polymeric-based membrane covering the first surface of the insulating material core and a second polymeric-based membrane covering the second surface of the insulating material core.

In an embodiment, at least one of the at least one polymeric-based membrane is a micro-perforated polymeric-based membrane.

In an embodiment, the at least one polymeric-based membrane is free of continuous discontinuity between a first one of the edges and a second one of the edges, opposed to the first one of the edges.

In an embodiment, an R-value of the insulating material core of the rigid insulating panel is at least 2.5 ($hr \cdot ft^{2} \cdot {}^{\circ}F.$)/BTU·in.

In an embodiment, the insulating material core is formed of one of shaped expanded polystyrene, extruded polystyrene, polyurethane, polyisocyanurate and phenolic foam.

In an embodiment, a thickness of the at least two rigid insulating panels is between about 0.75 inch and about 6 inches.

In an embodiment, the insulating material core of the at least two rigid insulating panels has a compressive strength of between about 8 psi and about 40 psi.

According to another general aspect there is also provided an assembly method for insulating a concrete surface of a building using a rigid insulating panel assembly as described above. The method comprises the steps of engaging connecting members of the at least two rigid insulating panels substantially perpendicularly to the first surface and the second surfaces of the insulating material core of the at least two rigid insulating panels; and pouring concrete alongside the rigid insulating panel assembly to form the concrete surface of the building.

In an embodiment, the step of pouring concrete alongside the insulating panel assembly to form the concrete surface of the building includes pouring concrete over the insulating panel assembly.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

Figure 1:
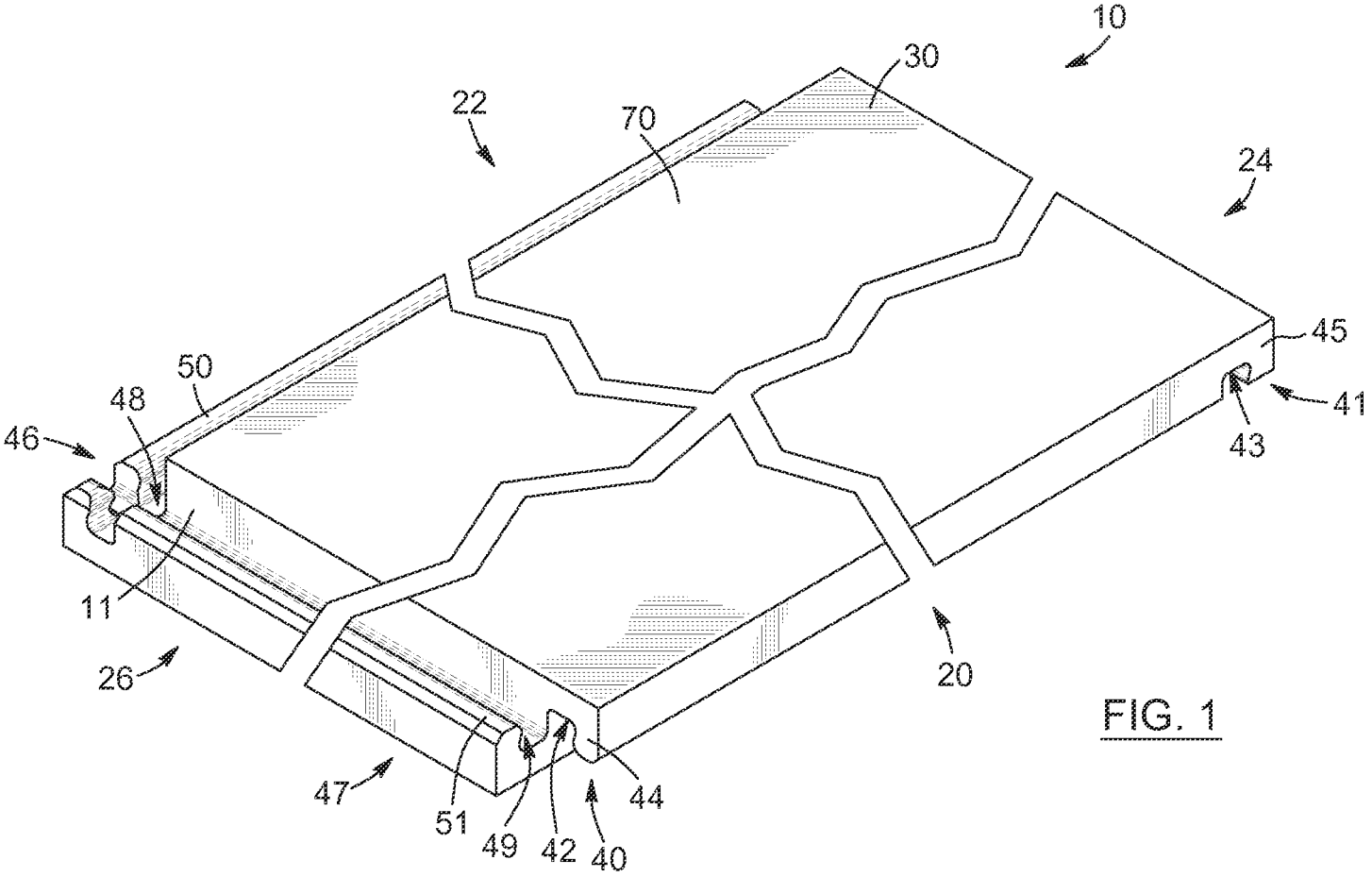
FIG. 1 is a top perspective view of a rigid insulating panel according to an embodiment.

FIG. **10*a* is a front elevation schematic representation of an assembly to perform flexural tests on two rigid insulating panels of FIG. 1** interconnected together.

FIG. **10*b* is a front elevation schematic representation of an assembly to perform flexural tests on the rigid insulating panel of FIG. 1**.

DETAILED DESCRIPTION

In the following description, the same numerical references refer to similar elements. The embodiments, geometrical configurations, materials mentioned and/or dimensions shown in the figures or described in the present description are embodiments only, given solely for exemplification purposes.

Moreover, although the embodiments of the rigid insulating panel and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, can be used for the rigid insulating panel, as will be briefly explained herein and as can be easily inferred herefrom by a person skilled in the art. Moreover, it will be appreciated that positional descriptions such as "above", "below", "upper", "lower", "top", "bottom", "left", "right" and the like should, unless otherwise indicated, be taken in the context of the figures and should not be considered limiting.

Referring generally to FIG. 1, there is provided a rigid insulating panel 10. The rigid insulating panel 10 has a rigid or semi rigid insulating material core 11 with a first longitudinal edge 20, a second longitudinal edge 22, a first lateral edge 24, and a second lateral edge 26. The first longitudinal edge 20 is located opposite to the second longitudinal edge 22 and substantially parallel thereto and the first lateral edge 24 is located opposite to the second lateral edge 26 and substantially parallel thereto, to form a polygon having a first surface 30 and a second surface 32, spaced-apart from one another. The lateral edges 24, 26 extend between the longitudinal edges 20, 22. In an embodiment, the rigid insulating panel 10 is made of shaped expanded polystyrene (EPS), which results in a rigid panel having insulation and resiliency properties. One skilled in the art will understand that, in alternative embodiments, other rigid materials having similar properties, such as extruded polystyrene (XPS), polyurethane (PU), polyisocyanurate (PIR), phenolic foam, organic based rigid or semi-rigid insulating material recognized as such in the field of construction, or the like, can also be used. The rigid insulating material core 11 can be any material having insulating properties which can be provided in a substantially rigid panel shape. In an embodiment, the rigid insulating material core 11 cannot be folded or rolled onto itself without breakage. The insulating material core 11 has a limited resilience and a high stiffness in comparison to flexible insulating material such as, for example, mineral wool.

In an embodiment, the insulating material core 11 of the rigid insulating panel 10 has an R-value (a measure of thermal resistance commonly used in the building and construction industry) of at least 2.5 (hr·ft$^{2}$·° F.)/BTU·in. More precisely, in an embodiment, the insulating material core 11 of the rigid insulating panel 10 has an R-value ranging between 2.5 and 30 (hr·ft$^{2}$·° F.)/BTU·in. In an embodiment the rigid insulating panel has a thickness of at least about 0.75 inch. More precisely, in an embodiment, the rigid insulating panel has a thickness ranging between about 0.75 inch and 6 inches. In an embodiment, the insulating material core 11 has a density between about 0.8 lb/ft$^{3}$ and about 2.3 lb/ft$^{3}$. Moreover, in an embodiment, the insulating material core 11 has a compressive strength between about 8 psi and about 40 psi. More precisely, in an embodiment, the insulating material core 11 has a compressive strength between about 15 psi and about 30 psi.

In the embodiment shown in FIG. 1, the insulating material core 11 includes a first connecting member 40 extending along the first longitudinal edge 20, a second connecting member 46 extending along the second longitudinal edge 22, a third connecting member 41 extending along the first lateral edge 24 and a fourth connecting member 47 extending along the second lateral edge 26. The connecting members 40, 41, 46, 47 extend between the first and the second surfaces 30, 32, along respective edges 20, 24, 22, 26.

The first connecting member 40 includes a first groove 42 and a first tongue 44. The first groove 42 and the first tongue 44 are successive to form a tongue and groove assembly (or male and female member assembly). Similarly, the second connecting member 46 includes a second groove 48 and a second tongue 50, the third connecting member 41 includes a third groove 43 and a third tongue 45 and the fourth connecting member 47 includes a fourth groove 49 and a fourth tongue 51. Each one of the second groove 48 and second tongue 50, the third groove 43 and third tongue 45 and the fourth groove 49 and fourth tongue 51 are also respectively successive to form tongue and groove assemblies.

One skilled in the art will understand that, in an alternative embodiment, the insulating material core 11 can be provided with connecting members along only one, two or three of the longitudinal edges 20, 22 and the lateral edges 24, 26. More particularly, in one embodiment, the insulating material core 11 can be provided with connecting members only along the first longitudinal edge 20 and the second longitudinal edge 22 or along the first lateral edge 24 and the second lateral edge 26. Moreover, in an embodiment, one of the first longitudinal edge 20 and the second longitudinal edge 22 or the first lateral edge 24 and the second lateral edge 26 which does not include connecting members as described above, can rather include complementary abutment lips (not shown).

Figure 9:
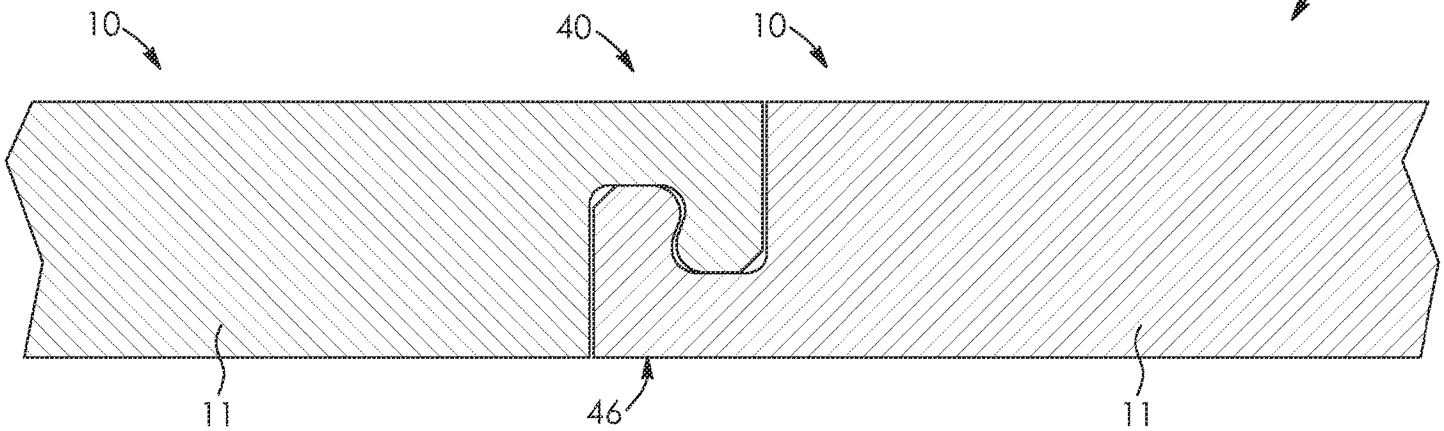
FIG. 9 is a cross-sectional view of two rigid insulating panels of FIG. 1 interconnected together to form a rigid insulating panel assembly.

In an embodiment and as better shown in FIGS. 1 and 4 to 7, the shape and size of the first groove 42 and the first tongue 44 of the first connecting member 40 is substantially complementary to the shape and size of the second groove 48 and second tongue 50 of the second connecting member 46. Similarly, the shape and size of the third groove 43 and the third tongue 45 of the third connecting member 41 is substantially complementary to the shape and size of the fourth groove 49 and fourth tongue 51 of the fourth connecting member 47. This configuration of the first connecting member 40, the second connecting member 46, the third connecting member 41 and the fourth connecting member 47 allows the first connecting member 40 of the rigid insulating panel 10 to be interlocked with the second connecting member 46 of an adjacent rigid insulating panel (not shown) and the third connecting member 41 of the rigid insulating panel 10 to be interlocked with the fourth connecting member 47 of another adjacent rigid insulating panel (not shown), to form an insulating panel assembly 80 (FIG. 9).

In an embodiment, each one of the grooves 42, 43, 48, 49 and the tongues 44, 45, 50, 51 extend substantially perpendicularly to the first surface 30 and the second surface 32 of the rigid insulating panel 10, i.e. the grooves 42, 43, 48, 49 are elongated recesses extending either from the first surface 30 or from the second surface 32 respectively while the tongues 44, 45, 49, 51 are elongated protrusions also extending upwardly from the second surface 32 or the first surface 30 respectively.

The term "substantially perpendicularly" is used herein to indicate that the grooves 42, 43, 48, 49 and the tongues 44, 45, 50, 51 are generally perpendicular to the first and second surfaces 30, 32 of the insulating material core 11, but do not need to be perfectly perpendicular with them. In other words, interlock of two adjacent rigid insulating panels 10 occurs by displacing at least one of the adjacent panels in a direction substantially perpendicular to its first and second surfaces 30, 32 rather than by displacing the adjacent panels laterally towards one another, i.e. along an axis substantially parallel to their first and second surfaces 30, 32.

In the embodiment shown, the first tongue and groove assembly of the first connecting member 40, located along the first longitudinal edge 20, extends downwardly with respect to the first surface 30 of the rigid insulating panel 10, i.e. the first groove 42 is open on the second surface 32. To be engageable with the first tongue and groove assembly of an adjacent one of the rigid insulating panels 10, the second tongue and groove assembly of the second connecting member 46, located along the second longitudinal edge 22 extends upwardly with respect to the first surface 30 of the rigid insulating panel 10, i.e. the groove 48 is open on the first surface 30. Similarly, to be engageable together when adjacent rigid insulating panels 10 are interlocked, the third and fourth tongue and groove assemblies extend in opposed directions. In the embodiment shown, the third tongue and groove assembly of the third connecting member 41, located along the first lateral edge 24, extends downwardly with respect to the first surface 30 of the rigid insulating panel 10. On the opposite, the fourth tongue and groove assembly of the fourth connecting member 47, located along the second lateral edge 26 extends upwardly with respect to the first surface 30 of the rigid insulating panel 10. Thus, the third and fourth grooves 43 and 49 are respectively open on the second surface 32 and the first surface 30.

Thus, when interconnected with an adjacent rigid insulating panel 10, as shown in FIG. 9, the first connecting member 40 of a first panel is engaged with the second connecting member 46 of a second panel. Thus, the shapes of the first and second connecting members 40, 46 are substantially complementary. Similarly, when interconnected with an adjacent rigid insulating panel 10, the third connecting member 41 of the first panel is engaged with the fourth connecting member 47 of a third panel (not shown). Similarly, the second and fourth connecting members 46, 47 of the first panel are respectively substantially complementary in shape and engageable with the first and the third connecting members 40, 41 of respective third and fourth adjacent insulating panels 10.

In the embodiment shown, the connecting members 40, 41, 46, 47 are configured to provide a flexible interconnection between the engageable ones of the connecting members 40, 41, 46, 47 of adjacent rigid insulating panels 10.

Therefore, when adjacent rigid insulating panels 10 are interconnected, a limited arcing movement can occur therebetween, along an arcing axis substantially parallel to the edge 20, 22, 24, 26 including the connecting members 40, 41, 46, 47. In the course of the present description, the term "arcing" is used to refer to a combined movement of flexion of the rigid insulating panels 10 and pivoting of the connecting members 40, 41, 46, 47. One skilled in the art would understand that, arcing can also be understood to refer to only flexion of the rigid insulating panels 10, for example and without being limitative, when a section of one of the connecting members 40, 41, 46, 47 is broken and pivoting no longer occurs. The limited arcing movement of the adjacent rigid insulating panels 10 is allowed either upwardly (wherein the first surfaces 30 are arced towards one another) or downwardly (wherein the second surfaces 32 are arced towards one another). The limited arcing movement of the adjacent rigid insulating panels 10 can occur without breaking the engagement between the rigid insulating panels 10 and without resulting in a breakage of the connecting members 40, 41, 46, 47. In an embodiment, the flexible interconnection between the connecting members 40, 41, 46, 47 results from a combination of the shape of the connecting members 40, 41, 46, 47, and the resiliency of the material thereof.

Figure 10A:
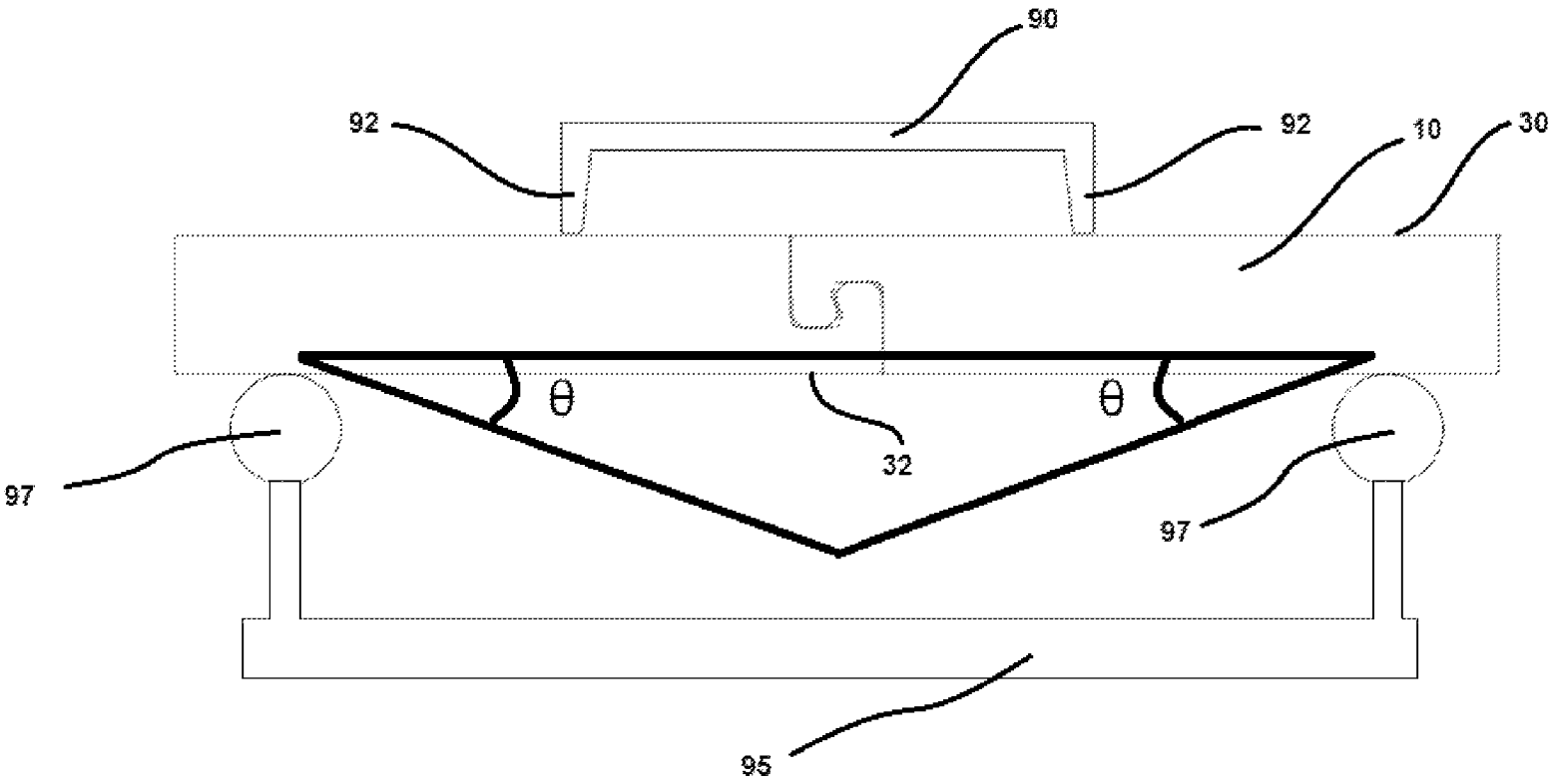

In an embodiment, the limited arcing movement can reach about 11°. Referring to FIG. 10*a*, the limited arcing movement is measured using method II of standard test method ASTM C-203 and corresponds to the angle "θ" between a first substantially horizontal axis extending longitudinally along the rigid insulating panels 10 when no pressure is applied thereon and a second axis extending longitudinally along each one of the rigid insulating panels 10 when a maximum pressure, without causing breaking of the engagement between the rigid insulating panels 10, is applied thereon. As can be seen in FIG. 10*a*, a pressure is applied by a first support 90 with pressure applicators 92 evenly spaced apart at quarter points, on either sides of one of the connecting members 40, 41, 46, 47 of adjacent rigid insulating panels 10 supported by a second support 95 with supporting members 97 evenly spaced apart on either side of the pressure applicators 92 of the first support 90. The distance between the pressure applicators 92 is one half of the distance between the supporting members 97. In an embodiment and without being limitative, the distance between the pressure applicators 92 of the first support 90 is five inches and the distance between the supporting members 97 of the second support 95 is ten inches, with the first support 90 being centered between the supporting members 97 of the second support 95.

In an embodiment and as better shown in FIGS. 4 to 7, in the tongue and groove assembly of the connecting members 40, 41, 46, 47, the grooves 42, 48, 43, 49 are located inwardly with respect to the tongues 44, 50, 45, 51 (or the tongues 44, 50, 45, 51 are located outwardly with respect to the grooves 42, 48, 43, 49).

Figure 8:
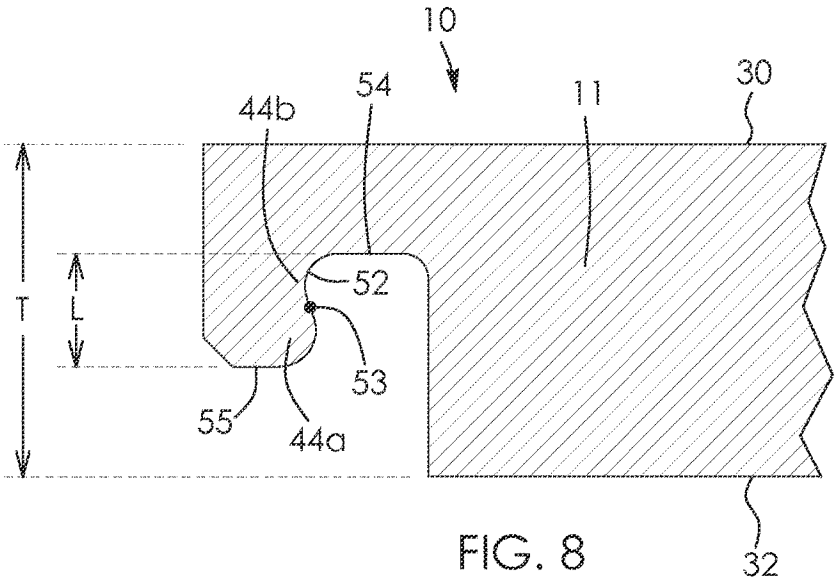
FIG. 8 is a cross-sectional view of a portion of the rigid insulating panel of FIG. 1 showing a first connecting member.

Now referring to FIG. 8, a median wall 52 separates the consecutive groove 42 and tongue 44 and defines at least partially the substantially complementary shapes of the consecutives groove 42 and tongue 44. One skilled in the art will understand that while FIG. 8 shows only the first connecting member 40, the present teachings regarding the configuration of the median wall 52, the groove 42 and tongue 44 with reference to the first connecting member 40 shown in FIG. 8 also apply to the other connecting members 41, 46, 47. In the embodiment shown, the median wall 52 is substantially S-shaped (with the "S" shape being rotated or inverted in some of the other connecting members 41, 46 or 47 (not shown)). The S-shaped median wall 52 defines a convex section 44*a* and a concave section 44*b* of the tongue 44, consecutive to one another. As will be easily understood, the corresponding groove 42 consequently presents convex and concave sections, inverted with respect to the convex section 44*a*, and the concave section 44*b* of the tongues 44. The convex section of the groove 42 is substantially complementary in shape to the concave section of the tongue 44, and vice-versa.

In order to provide the flexible interconnection between the corresponding ones of the connecting members 40, 41, 46 and 47 of adjacent rigid insulating panels 10, each one of the S-shaped median wall 52 of the connecting members 40, 41, 46 and 47 has an inflection point 53. The inflection point 53 is positioned at a median of the insulating material core 11 of the rigid insulating panel 10, i.e. midway between the first surface 30 and the second surface 32 of the insulating material core 11 of the rigid insulating panel 10. The inflection point 53 also corresponds to a point of inflection in the curvature of the median wall 52 and separates the convex section 44*a* and the concave section 44*b* of the tongue 44.

The convex section 44*a* of the tongue 44 is defined by a protuberance at a distal section of the tongue 44, i.e. a section of the tongue 44 distal from the first surface 30 of the insulating material core 11 from which the tongue 44 extends. The concave section 44*b* of the tongue 44 is defined by a cavity at a proximal section thereof, i.e. a section of the tongue 44 proximal to the first surface 30 of the insulating material core 11 from which the tongue 44 extends. Thus, the tongue 44 is thicker in its distal section than in its proximal section. One skilled in the art will understand that, for the second connecting member 46 and the fourth connecting member 47, where the tongue extends from the second surface 32 of the insulating material core 11, the distal section and the proximal section are defined with regards to the second surface 32 rather than the first surface.

Still referring to FIG. 8, the insulating material core 11 has a thickness "T" between the first and the second surfaces 30, 32. There is shown that, in an embodiment, the tongue 44 is characterized by a length "L", defined between a proximal end 54 of the tongue and groove assembly, corresponding to a bottom of the groove 42 and a distal end 55 of the tongues 44. The length "L" of the tongues 44 also corresponds to the length of the tongue and groove assembly. In an embodiment, the inflection point 53 is provided midway along the length "L" of the tongue 44. In the embodiment shown, the length "L" of the tongue 44 is about ⅓ of the thickness "T" of the insulating material core 11. Indeed, in the embodiment shown, the insulating material core 11 is dividable into three thirds between the first and the second surfaces 30, 32. A first third extends between one of the first and the second surfaces 30, 32 and the proximal end 54 of the tongue and groove assembly, a second third extends along the length "L" of the tongue and groove assembly, and a third extends between the other one of the first and the second surfaces 30, 32 and the distal end 55 of the tongue and groove assembly. However, one skilled in the art will understand that, in an alternative embodiment, the length "L" of the tongue 44 can be less than ⅓ of the thickness "T" of the insulating material core 11. In other words, it will be understood that the portions corresponding to the first third and the third third of the illustrated embodiment can be thicker than the portion corresponding to the second third (i.e. the portion extending along the length "L" of the tongue and groove assembly), of the illustrated embodiment.

Referring to FIGS. 1 to 9, in the embodiment shown, when the connecting members 40, 41, 46 or 47 of a first one of the rigid insulating panels 10 engages a connecting member 40, 41, 46 or 47 of an adjacent one of the rigid insulating panels 10, the resiliency of the material of the rigid insulating panels 10 causes the connecting members 40, 41, 46 or 47 to deform momentarily during the engagement therebetween (as a result of the convex sections 44*a*, 50*a*, 45*a*, 51*a* and the concave sections 44*b*, 50*b*, 45*b*, 51*b* of the tongues, 44, 50, 45, 51), and subsequently return to their original shape when the interlock of the adjacent panels 10 is achieved. This momentary deformation of the shape of the connecting members 40, 41, 46, 47 during the engagement results in a sturdier interlock between the connecting members 40, 41, 46, 47. Tests have shown that, in an embodiment, each tongue of interlocking connecting members 40, 41, 46, 47 can deform to a maximum of about 13% of its size and the combination of two interlocking connecting members 40, 41, 46, 47 can deform to a maximum of about 20% of the overall size of the two tongues of the interlocking connecting members 40, 41, 46, 47, with the tongues of the interlocking connecting members 40, 41, 46, 47 returning to between about 95% and about 100% of their original size following a deformation.

One skilled in the art will understand that even though one configuration of the first connecting member 40, the second connecting member 46, the third connecting member 41 and the fourth connecting member 47 is shown in the illustrated embodiment, in an alternative embodiment, the connecting members 40, 41, 46, 47 can present different size, shape, and configuration which also allow a sturdy flexible interconnection therebetween, with the above described inflection point 53 positioned midway between the first surface 30 and the second surface 32 of the rigid insulating panel 10. For example and without being limitative, in an embodiment (not shown), the connecting members 40, 41, 46, 47 can extend discontinuously along the edges 20, 22, 24, 26.

Now referring back to FIGS. 1 to 3, in order to allow the rigid insulating panel 10 to maintain its integrity, even in the occurrence of a breakage in the insulating material core 11, the panel 10 is provided with a membrane 70 covering at least one of the first surface 30 and the second surface 32. As will be understood, the membrane 70 is configured to allow the integrity of the rigid insulating panel 10 to be maintained (i.e. allow the connection between pieces of insulating material core 11 separated by a rupture to be maintained along a surface) even when a section of the insulating material core 11 (including the connecting member 40, 41, 46 and 47) breaks or ruptures, for instance because pressure is applied on the rigid insulating panel 10 resting on an uneven surface (not shown). Moreover, in an embodiment, the membrane 70 improves the resistance of the panel 10 to breakage of the insulating material core 11, i.e. the panel 10 can sustain a greater force applied thereon before breaking, by absorbing the surface tension of the insulating material core 11.

In an embodiment, the membrane 70 is a film continuously bounded, for example and without being limitative using a thermal roller to perform thermal transfer and/or hot melt glue, to fuse the film with the rigid or semi rigid insulating material core 11, at the at least one of the first surface 30 and the second surface 32, of the insulating material core 11. Such continuous bounding results in a load transfer between the core 11 and the membrane 70 when the rigid insulating panel 10 is under stress, thereby increasing the overall mechanical properties of the rigid insulating panel 10. One skilled in the art will understand that, in alternative embodiments, other bounding techniques and/or methods, such as, and without being limitative, lamination, can be used to continuously join the membrane 70 to the rigid or semi rigid insulating material core 11, at the at least one of the first surface 30 and the second surface 32 thereof.

For example and without being limitative, the membrane 70 may be a polymeric-based membrane, such as a film made of polyester, polyolefin, polypropylene, polyethylene, nylon, foil, polyvinyl chloride, bioplastic or a liquid applied plastic coating, a fiber-based film, such as natural fiber, with a polymeric binder, a polymeric mesh film, or the like. In an embodiment, the membrane is a plastic membrane.

In an embodiment, the thickness of the membrane 70 is negligible in comparison with the thickness "T" of the insulating material core 11.

Figure 2:
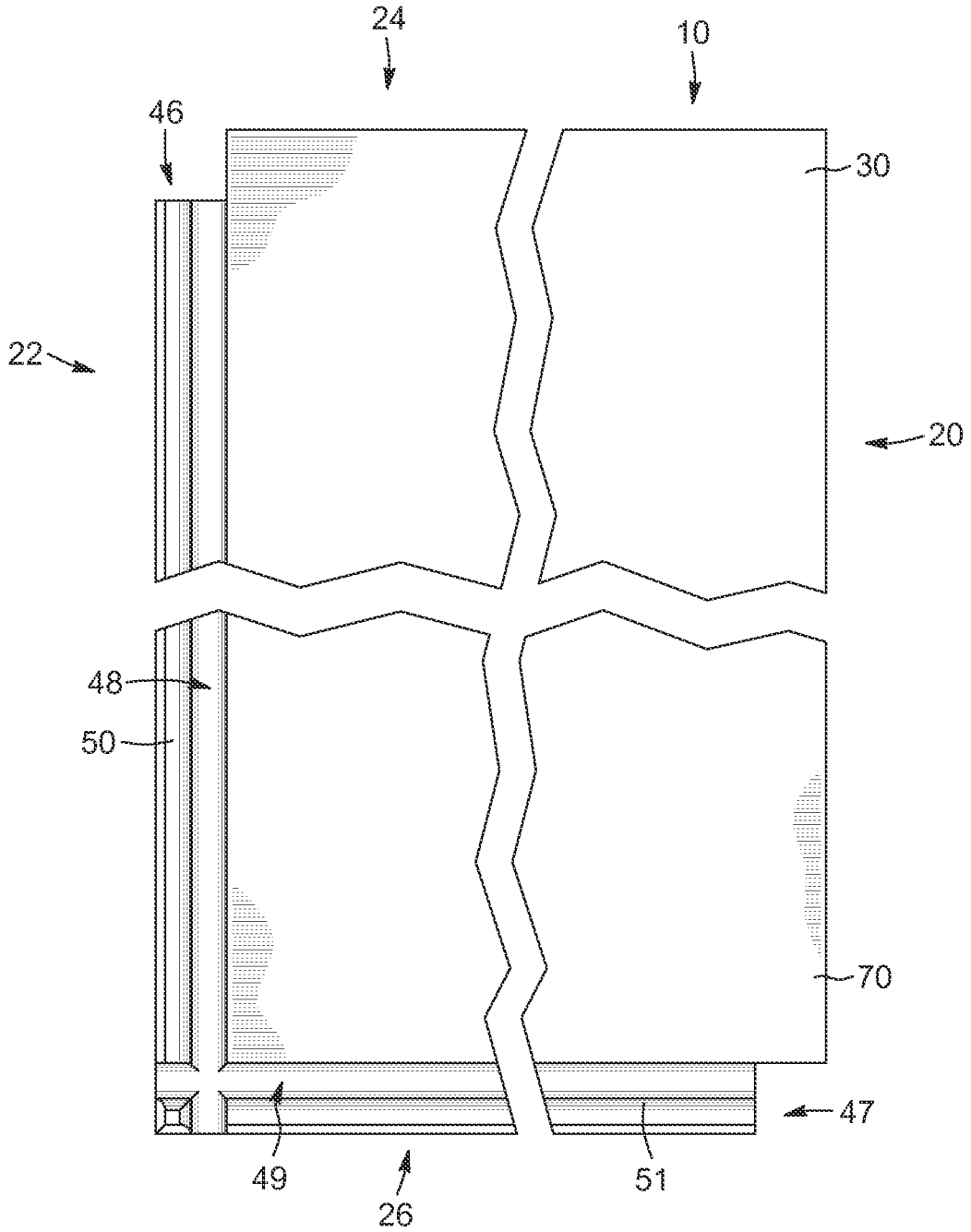
FIG. 2 is a top plan view of the rigid insulating panel of FIG. 1.
Figure 3:
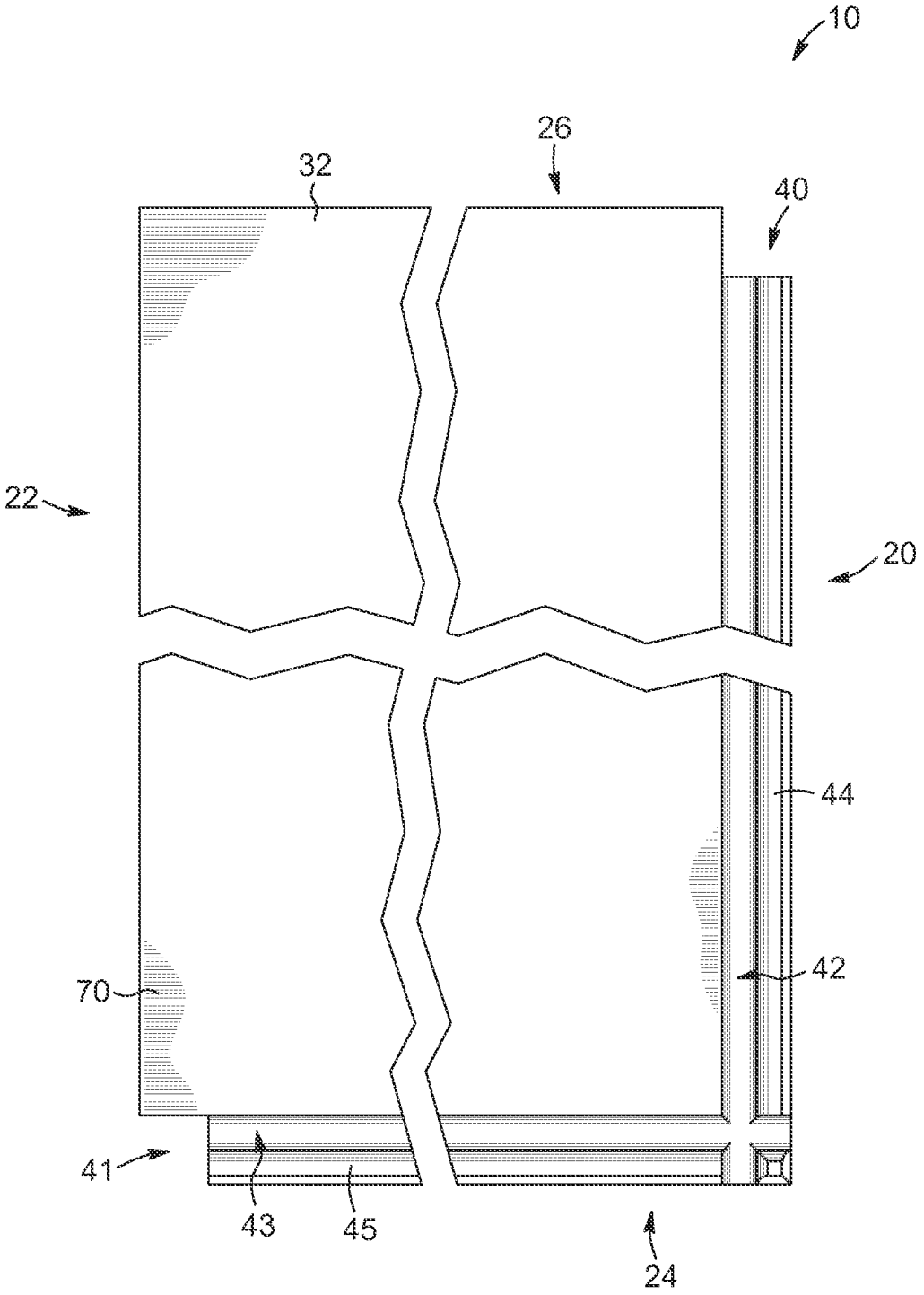
FIG. 3 is a bottom plan view of the rigid insulating panel of FIG. 1.
Figure 4:
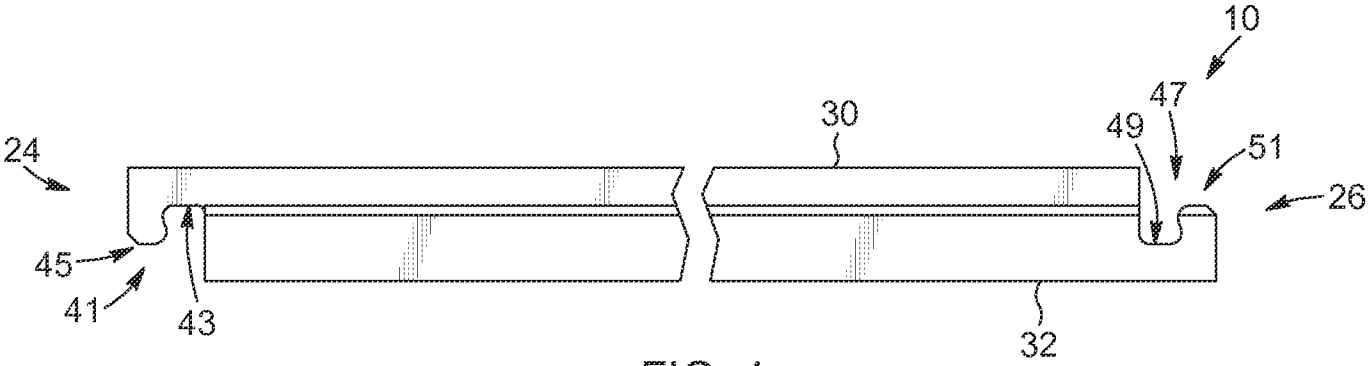
FIG. 4 is a left-side elevation view of the rigid insulating panel of FIG. 1.
Figure 5:
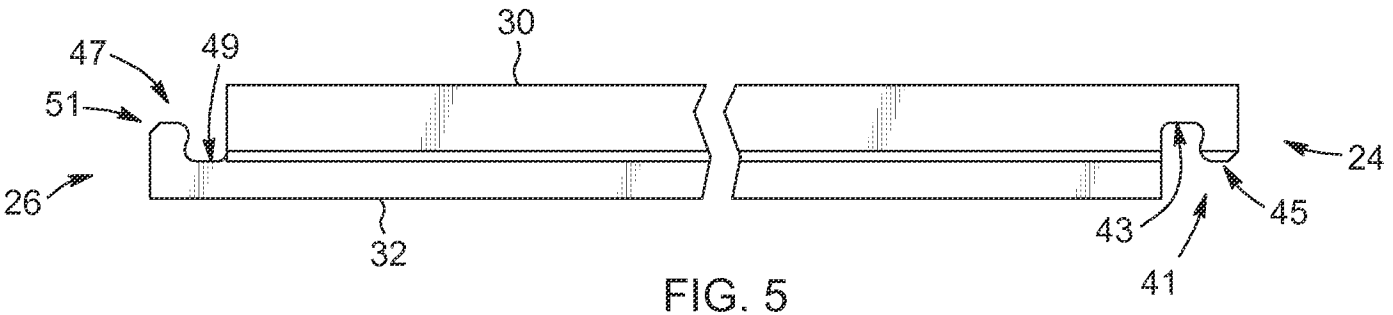
FIG. 5 is a right-side elevation view of the rigid insulating panel of FIG. 1.
Figure 6:
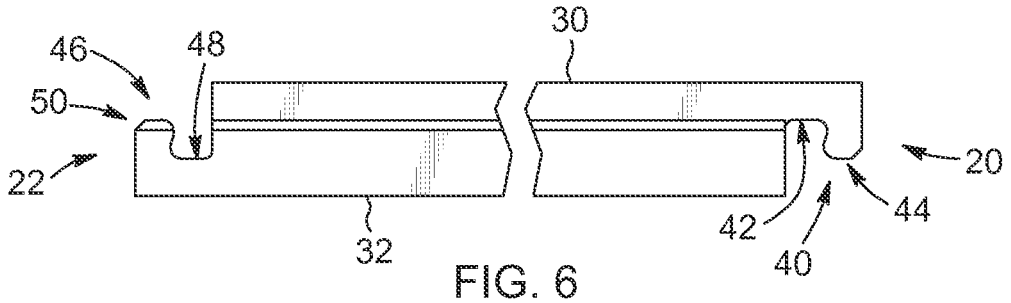
FIG. 6 is a front elevation view of the rigid insulating panel of FIG. 1.
Figure 7:
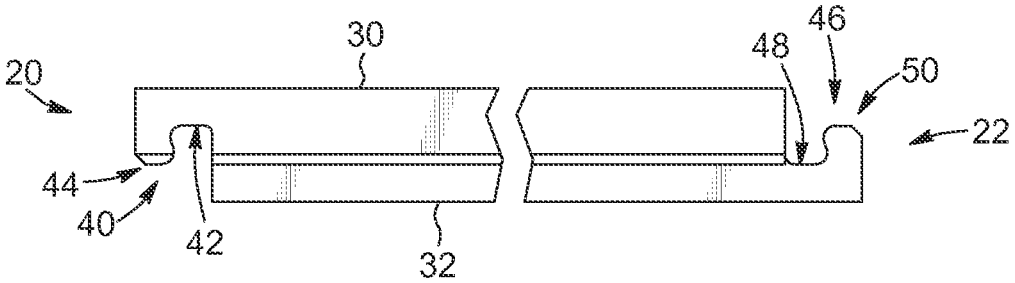
FIG. 7 is a rear elevation view of the rigid insulating panel of FIG. 1.

Still referring to FIGS. 1 to 3, in the embodiment shown, the membrane 70 extends over the first surface 30, the second surface 32 and into the connecting members 40, 41, 46 and 47, i.e. it at least partially follows the shape of the consecutive groove and tongue. One skilled in the art will however understand that, in an embodiment the membrane can extend past the first surface 30 and/or the second surface 32 without extending into the corresponding connecting member 40, 41, 46, 47. In such an embodiment, the membrane 70 can be positioned in the corresponding connecting member 40, 41, 46, 47 upon interconnection of the rigid insulating panel 10 with another adjacent rigid insulating panel 10. For instance, the membrane can cover at least part of the grooves 42, 43, 48, 49.

It will be understood that, in an embodiment, membranes 70 with different properties can also be provided over different sections or surfaces of the rigid insulating panel 10. For example and without being limitative, in an embodiment (not shown), the membrane 70 covering the first surface can be unperforated while the membrane covering the second surface 32 (for instance, the lower surface when the panel is applied horizontally) of the rigid insulating panel 10 can be micro-perforated, or vice-versa. Tests have shown that the use of a micro-perforated membrane 70 to cover the second surface 32 of the rigid insulating panel 10 results in a diminution of the noise when a fracture of the micro-perforated membrane occurs, as well as favoring the flow of liquid and/or vapor therethrough. Moreover, the micro-perforated membrane 70 helps guiding fracture lines, which result from fractures of the micro-perforated membrane and/or the rigid or semi rigid insulating material core 11, longitudinally along the micro-perforations of the membrane.

In an embodiment, a sole membrane 70 covers either the first or the second surfaces 30, 32 of the insulating material core 11. In an embodiment, the membrane covering either the first or the second surfaces 30, 32 of the insulating material core 11 is free of continuous discontinuities, i.e. discontinuities extending from one of the edges 20, 22, 24, 26 to an opposed one of the edges 20, 22, 24, 26.

The rigid insulating panels 10 including the above membrane 70 results in rigid insulating panels 10 with increased flexibility and resistance to rupture thereof. Moreover, the rigid insulating panels 10 including the combination of the above-described membrane 70 and the above-described connecting members 40, 41, 46, 47 results in the insulating panel assembly 80 of adjacent interlocked rigid insulating panels 10 that also has increased flexibility and resistance to rupture.

The results of tests conducted using rigid insulating panels 10 with a rigid insulating material core made of EPS of 1.25 inch thick, a length of about 12 inches and a width of about 3 inches are presented in Table 1 and Table 2 below. Compressive strengths of respectively 16 psi, 20 psi, and 30 psi were used and the tests were conducted according to methods of the standard test method ASTM C-203, using the assemblies shown respectively in FIGS. 10*a* and 10*b*. The assembly of FIG. 10*a* has been described in details above and the assembly of FIG. 10*b* will be described below.

Table 1 below shows results of tests directed to the maximum arcing movement corresponding to the angle "θ" in FIG. 10*a*. For each one of the compressive strengths, eight samples were tested according to method II of the standard test method ASTM C-203, with the assembly shown in FIG. 10*a*. Table 1 below shows the average results of the eight samples, where the column labeled "Max deflection" represents the maximum distance travelled vertically by the rigid insulating panels 10 between the original position where no pressure is applied thereon and the final position where a maximum pressure is applied, without causing breaking of the engagement between the rigid insulating panels 10; and the column labelled "Max piv. mov." represents the maximum arcing movement.

TABLE 1

| Panel compressive strength | Max deflection | Max piv. mov. |
|---|---|---|
| 16 psi | 0.49 inch | 11.02° |
| 20 psi | 0.40 inch | 9.09° |
| 30 psi | 0.37 inch | 8.31° |

Figure 10B:
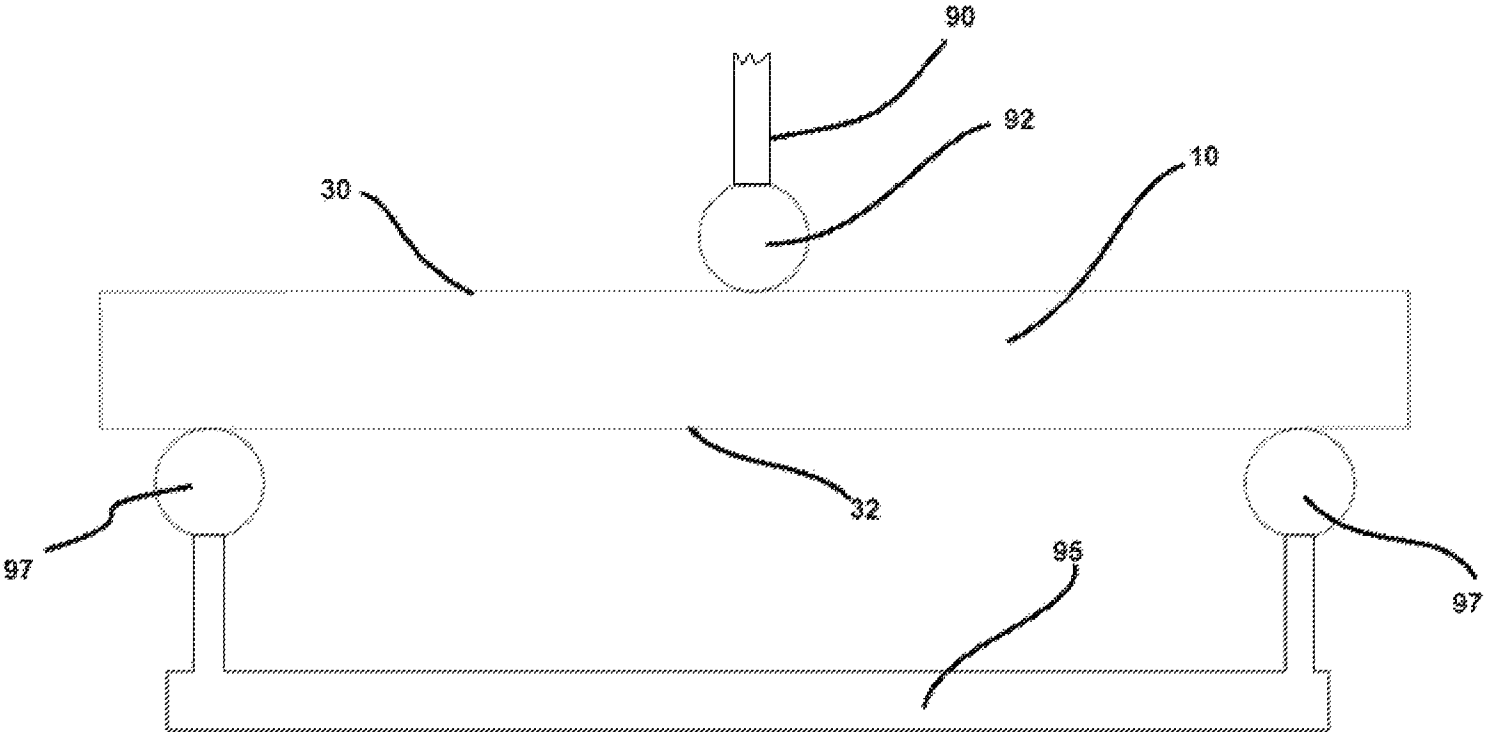

Table 2 below shows results of tests directed to a maximum fiber stress (labelled "Max fiber stress" in Table 2), i.e. a maximum force which can be applied on a panel before a rupture of the insulating material core 11 occurs. For each one of the compressive strengths (16 psi, 20 psi, 30 psi), four samples were tested for each of three different membrane configurations: without membrane (labeled "no" in Table 2), with a perforated membrane on the first surface 30 and an unperforated membrane on the second surface 32 (labelled "Upper perforated" in Table 2), and with an unperforated membrane on the first surface 30 and a perforated membrane on the second surface 32 (labelled "Lower perforated" in Table 2). The samples were tested according to method I of the standard test method ASTM C-203, using the assembly shown in FIG. 10*b*. The assembly of FIG. 10*b* is similar to the assembly of FIG. 10*a*, with the exception that it provides a single support 90 with a single pressure applicator 92 applying a single point of pressure in the center of a single panel 10, rather than a support with evenly spaced apart pressure applicators 92 applied on adjacent panels 10. Table 2 below shows the average results of the four samples for each membrane configuration.

TABLE 2

| Panel compressive strength | Membrane configuration | Max Fiber Stress | Gain |
|---|---|---|---|
| 16 psi | No | 35.95 psi | N/A |
| | Upper perforated | 46.86 psi | 30% |
| | Lower perforated | 44.16 psi | 23% |
| 20 psi | No | 51.23 psi | N/A |
| | Upper perforated | 66.18 psi | 29% |
| | Lower perforated | 62.94 psi | 23% |
| 30 psi | No | 84.83 psi | N/A |
| | Upper perforated | 99.72 psi | 18% |
| | Lower perforated | 93.96 psi | 11% |

The rigid insulating panel 10 and the rigid insulating panel assembly 80 formed of such adjacent interlocked rigid insulating panels 10 having been described above, an assembly method for forming an insulating barrier for a surface, such as a concrete surface, using the above described rigid insulating panels 10 will now be described. In an embodiment, the surface is a concrete surface of a building, such as, for example and without being limitative, a concrete slab, foundation or wall.

In such a method, at least two rigid insulating panels 10 such as the one described above are provided. The rigid insulating panels 10 are engageable with one another through substantially complementary connecting members 40, 41, 46 or 47, and have a membrane 70 configured to maintain the integrity of the rigid insulating panel 10 in the occurrence of a breakage. In order to form the insulating panel assembly 80, the connecting members 40, 41, 46 or 47 of adjacent rigid insulating panels 10 are engaged with one another to interlock the adjacent rigid insulating panels 10. The engagement is performed by pressing the corresponding connecting members 40, 41, 46 or 47 together substantially perpendicularly to the first surface 30 of the rigid insulating panels 10, for the connecting members 40, 41, 46 or 47 to interlock. Such an engagement results in a flexible interconnection therebetween, as described above.

Concrete can be poured alongside the rigid insulating panel assembly before or after the above-described engagement of the rigid insulating panels 10. In the course of the present application, the term "alongside" is used to describe that the concrete can be poured next to the first surface 30 or the second surface 32 of the rigid insulating panels 10 of the rigid insulating panel assembly, which can be positioned substantially horizontally or vertically. For example and without being limitative, concrete can be poured over (i.e. on top of) the rigid insulating panel assembly positioned substantially horizontally.

In an alternative embodiment, concrete can be poured to form a concrete slab and the rigid insulating panel assembly can be subsequently assembled and rested substantially horizontally over the concrete slab. Moreover, in another alternative embodiment, the rigid insulating panel assembly can be used for insulating foundation wall by pouring the concrete to form foundation walls with the rigid insulating panel assembly being positioned substantially vertically internally or externally therefrom.

One skilled in the art will understand that, therefore, the rigid insulating panel assembly can be used over or under a concrete slab, to provide insulation internally and/or externally of foundation walls, or the like. In an alternative embodiment, the rigid insulating panel assembly can also be used to provide insulation, internally or externally, to walls extending above the ground.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention can be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the scope of the invention as defined in the appended claims.

The invention claimed is:

1. A rigid floor insulating panel comprising:

an insulating material core with an R-value of at least 2.5 (hr·ft$^2$·° F)/BTU·in, the insulating material core having opposed first and second substantially flat surfaces, a pair of spaced-apart longitudinal edges, and a pair of spaced-apart lateral edges extending between the pair of longitudinal edges, at least one of the pair of longitudinal edges and the pair of lateral edges comprising connecting members, each one of the connecting members including a tongue and groove assembly consisting of an inner groove and an outer tongue with a single inflexion point positioned at a median of a length of the tongue and groove assembly, the inner groove and outer tongue being separated by a substantially S-shaped median wall defining consecutive convex and concave sections in the inner groove and the outer tongue with the single inflection point being located at the junction of the convex and concave sections, the tongue and groove assembly being engageable in a pivotable interconnection with the tongue and groove assembly of an adjacent rigid floor insulating panel; and at least one polymeric-based film covering one of the first surface and the second surface of the insulating material core.

2. The rigid floor insulating panel of claim 1, wherein the inflection point is positioned substantially at a median of the rigid floor insulating panel, between the first and the second surfaces.

3. The rigid floor insulating panel of claim 1, wherein the insulating material core has a thickness between the first and the second surfaces and the length of the tongue and groove assembly is at maximum ⅓ of the thickness of the insulating material core.

4. The rigid floor insulating panel of claim 1, wherein the outer tongue and the inner groove extend substantially perpendicular to the first surface and the second surface of the insulating material core.

5. The rigid floor insulating panel of claim 1, wherein the at least one polymeric-based film comprises a first polymeric-based film covering the first surface of the insulating material core and a second polymeric-based film covering the second surface of the insulating material core.

6. The rigid floor insulating panel of claim 1, wherein at least one of the at least one polymeric-based film is a micro-perforated polymeric-based film.

7. The rigid floor insulating panel of claim 1, wherein the at least one polymeric-based film comprises a sole polymeric-based film extending between a first one of the edges and a second one of the edges, opposed to the first one of the edges.

8. The rigid floor insulating panel of claim 1, wherein the insulating material core is formed of one of shaped expanded polystyrene, extruded polystyrene, polyurethane, polyisocyanurate and phenolic foam.

9. The rigid floor insulating panel of claim 1, wherein a thickness of the rigid insulating panel is between about 0.75 inch and about 6 inches.

10. The rigid floor insulating panel of claim 1, wherein the insulating material core has a compressive strength of between about 8 psi and about 40 psi.

11. The rigid floor insulating panel according to claim 1, wherein a distal end of the outer tongue includes a chamfered edge.

12. A rigid floor insulating panel assembly comprising:

at least two rigid insulating floor panels, each one of the rigid insulating floor panels comprising:

an insulating material core having a first substantially flat surface, an opposed second substantially flat surface, a pair of spaced-apart longitudinal edges and a pair of spaced-apart lateral edges extending between the pair of longitudinal edges, and at least two connecting members being provided at a respective one of the longitudinal edges and the lateral edges, each one of the connecting members comprising a tongue and groove assembly consisting of an S-shaped median wall separating an inner groove and an outer tongue with a single inflexion point positioned substantially at a median of the rigid floor insulating panel, the median wall defining consecutive convex and concave sections in the inner groove and the outer tongue with the single inflection point located at the junction of the convex and concave sections; and at least one polymeric-based film covering one of the first surface and the second surface of the insulating material core;

wherein adjacent ones of the connecting members of the at least two rigid floor insulating panels are engageable together with the single inflection point of each one of the connecting members allowing pivotable interlock between the adjacent ones of the at least two rigid floor insulating panels.

13. The rigid insulating floor panel assembly of claim 12, wherein the tongue and groove assembly has a length and the insulating material core has a thickness between the first surface and the second surface and the length of the tongue and groove assembly is at maximum ⅓ of the thickness of the insulating material core.

14. The rigid floor insulating panel assembly of claim 12, wherein the outer tongue and the inner groove extend substantially perpendicular to the first surface and the second surface of the insulating material core.

15. The rigid floor insulating panel assembly of claim 12, wherein the at least one polymeric-based film comprises a first polymeric-based film covering the first surface of the insulating material core and a second polymeric-based film covering the second surface of the insulating material core.

16. The rigid floor insulating panel assembly of claim 12, wherein at least one of the at least one polymeric-based film is a micro-perforated polymeric-based film.

17. The rigid floor insulating panel assembly of claim 12, wherein the at least one polymeric-based film comprises a sole polymeric-based film extending between a first one of the edges and a second one of the edges, opposed to the first one of the edges.

18. The rigid floor insulating panel assembly of claim 12, wherein an R-value of the the insulating material core of the rigid insulating panel is at least 2.5 (hr·ft$^2$·° F)/BTU·in.

19. The rigid floor insulating panel assembly of claim 12, wherein the insulating material core is formed of one of shaped expanded polystyrene, extruded polystyrene, polyurethane, polyisocyanurate and phenolic foam.

20. The rigid insulating panel assembly of claim 12, wherein a thickness of the at least two rigid floor insulating panels is between about 0.75 inch and about 6 inches.

21. The rigid floor insulating panel assembly of claim 12, wherein the insulating material core of the at least two rigid floor insulating panels has a compressive strength of between about 8 psi and about 40 psi.

22. The rigid floor insulating panel according to claim 12, wherein a distal end of the outer tongue includes a chamfered edge.

23. A rigid floor insulating panel, the rigid floor insulating panel comprising:

an insulating material core with an R-value of at least 2.5 (hr·ft$^{2}$·° F)/BTU·in, the insulating material core having opposed first and second substantially flat surfaces, a pair of spaced-apart longitudinal edges, and a pair of spaced-apart lateral edges extending between the pair of longitudinal edges, at least one of the pair of longitudinal edges and the pair of lateral edges comprising connecting members, each one of the connecting members including a tongue and groove assembly consisting of an inner groove and an outer tongue with a single inflexion point, the inner groove and the outer tongue being separated by a substantially S-shaped median wall, the inner groove being defined partially by a substantially straight inner wall extending substantially perpendicular to one of the first and second surfaces, the tongue and groove assembly being engageable in a pivotable interconnection with the tongue and groove assembly of an adjacent rigid floor insulating panel; and at least one polymeric-based film covering one of the first surface and the second surface of the insulating material core.

24. The rigid floor insulating panel according to claim 23, wherein a distal end of the outer tongue includes a chamfered edge.

* * * * *